United States Patent [19]

Kabashima

[11] Patent Number: 4,487,406

[45] Date of Patent: Dec. 11, 1984

[54] CASSETTE TYPE APPARATUS FOR FEEDING PAPERS

[75] Inventor: Akio Kabashima, Kanagawa, Japan

[73] Assignee: Fuji Xerox Co., Ltd., Tokyo, Japan

[21] Appl. No.: 459,911

[22] Filed: Jan. 21, 1983

[30] Foreign Application Priority Data

Mar. 8, 1982 [JP] Japan ..... 57-36277

[51] Int. Cl.[3] ..... B65H 1/08

[52] U.S. Cl. ..... 271/127; 271/160; 271/164

[58] Field of Search ..... 271/126, 127, 22, 24, 271/160, 162, 164

[56] References Cited

U.S. PATENT DOCUMENTS 3,672,665 6/1972 Schnall ..... 271/164

4,221,375 9/1980 Morrison ..... 271/162 X

*Primary Examiner*—Richard A. Schacher

*Attorney, Agent, or Firm*—Sughrue, Mion, Zinn, Macpeak, and Seas

[57] ABSTRACT

A cassette type apparatus, for feeding papers from a cassette insertable into a copier having a feed roller, has a pressing member which automatically engages and presses a bottom of the cassette towards the feed roller when the cassette is inserted into the copier.

7 Claims, 8 Drawing Figures

CASSETTE TYPE APPARATUS FOR FEEDING PAPERS

BACKGROUND OF THE INVENTION

1. Field of the Invention

The present invention relates to a cassette type apparatus for feeding papers in copying machines, printing machines and the like.

2. Description of the Prior Art

Referring to FIG. 1, in accordance with a conventional cassette type paper feeding apparatus, a cassette 2 having papers 1 therein is inserted into the copier, printer, etc., and the papers 1 are pushed against a feed roller 3 with a suitable pressure. Hence, a pressing member 4 is provided to push against a bottom plate 5 of the cassette 2 by the operation of a lever (not shown). However, it is required that the lever be operated whenever the cassette is inserted into the copier, printer, etc. which causes an inconvenience since it is troublesome to operate the lever. In addition, further inconvenience is encountered since it is impossible to feed the papers if the lever is not properly operated.

SUMMARY OF THE INVENTION

Accordingly, it is an object of the present invention to provide a cassette type apparatus for feeding papers which automatically sets a pressing member merely by inserting the cassette in the apparatus.

According to the invention, a cassette type apparatus for feeding papers comprises a lever one end of which is fixed to a rotary shaft to which is fixed a pressing member for pushing papers in a cassette against a feed roller and which is spring-biased in the pushing direction, a block for determining a position which is spring-biased in such a way as to engage the other end of the lever so as to retain the lever in a retracted position and which is supported in such a way as to make a swinging motion, and a slider which is slid by the insertion of the cassette for feeding papers so as to come in contact with the block and make it swing, thereby making it possible to release the lever by movement of the block.

In accordance with the apparatus as described above, since the slider, which is slid by the cassette, comes in contact with the block merely by inserting the cassette, the block is caused to swing which releases the lever. Accordingly, the lever and the pressing member move in the pressing direction due to a spring-bias force in such a way that the papers in the cassette are pushed against the feed roller. Therefore, it is not necessary to separately set the pressing member.

Then, when the cassette is to be drawn out, the above-mentioned lever is rotated in the direction opposite to the pressing direction by means of another lever, so that the end thereof is again retained by the block. Accordingly, the pressing member is kept in a retracted position without disturbing the operation of withdrawing the cassette.

DESCRIPTION OF THE PREFERRED EMBODIMENT

Figure 1:
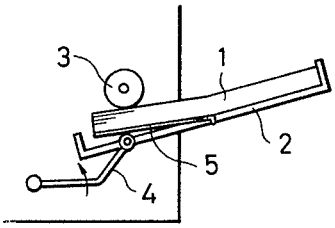
FIG. 1 is a schematic view showing a conventional cassette type apparatus for feeding papers.
Figure 2:
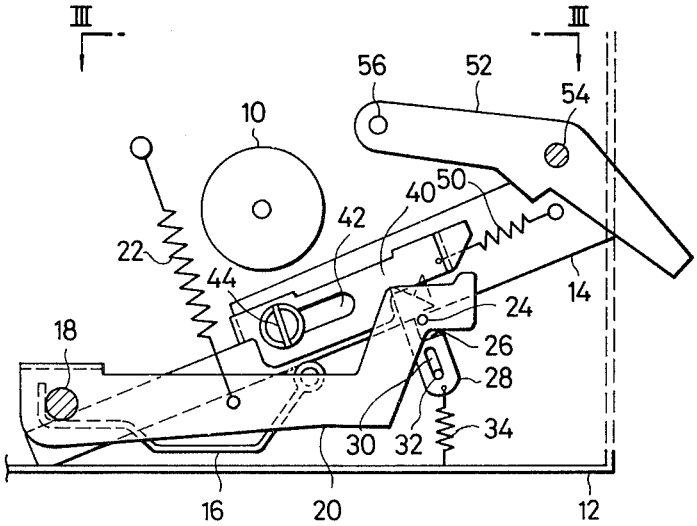
FIG. 2 is a side view showing an embodiment of a cassette type apparatus of the present invention prior to insertion of the cassette.
Figure 3:
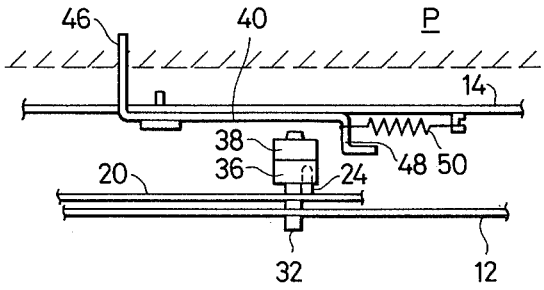
FIG. 3 is a partially abbreviated top plan view as seen from line III—III in FIG. 2.
Figure 4:
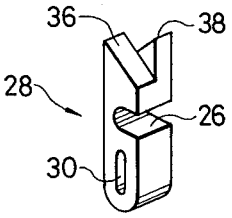
FIG. 4 is a perspective view showing a block 28 for determining position used in the apparatus of FIG. 2.

FIG. 2 illustrates a side view of a cassette type apparatus which actuates a pressing member 16 in the state where the cassette for feeding papers has not yet been inserted. FIG. 3 is a partially abbreviated top plan view as seen from line III—III in FIG. 2.

A feed roller 10 is rotatably supported by a frame 12 of the apparatus which is partly shown in FIG. 2 in such a way as to be rotatable by means of a lever 20. An auxiliary frame 14 has a guide means for guiding the cassette below the feed roller 10 as the cassette is inserted into the copier, printer, etc. The auxiliary frame is also fixed onto the frame 12 of the apparatus. A pressing member 16 for pushing up a bottom plate of the cassette when the cassette is inserted into the copier, printer, etc. is fixed to a shaft 18 which is rotatably supported by the frame 12 of the apparatus. One end of a lever 20 is fixed onto the portion of the shaft 18 which extends outside of the auxiliary frame 14. A spring 22 is connected to the central part of the lever 20 in such a way that the lever 20 is biased to rotate counterclockwise in FIG. 2. Therefore, the pressing member 16 is also biased counterclockwise by means of the spring 22 via the common engagement of the pressing member 16 and lever 20 with the shaft 18. When the lever 20, which is retained, is released as described below, the pressing member 16 pushes the bottom plate of the cassette from below toward the feed roller 10.

A pin 24 is fixed onto a side surface of the other end of the lever 20 which is opposite the shaft 18. A block 28 for determining a position of the lever 20 has a notch 26 for receiving the pin 24 therein. The block 28 also has an elongated slot 30 below the notch 26 as shown in FIG. 2. A pin 32 which is fixed onto the frame 12 of the apparatus is inserted into the slot 30. In addition, a spring 34 is connected to a lower end of the block 28 and biases the block 28 downwards. One half of an upper portion of the block 28 which faces the lever 20 has an inclined surface 36 for guiding the pin 24 of the lever 20 into the notch 26, and the other half of the upper portion of the block 28 has a surface 38 which is inclined in a direction which is opposite to that of the inclined surface 36. In addition, a slider 40 which slides along the auxiliary frame 14 is mounted onto the auxiliary frame 14. An elongated slot 42 is formed in the central part in the slider 40. A pin 44 which is fixed onto the auxiliary frame 14 is inserted into this slot 42. Therefore, the amount of sliding movement of the slider 40 is regulated by the slot 42. One end of the slider 40 extends into a passage P into which the cassette is inserted as shown in FIG. 3, in such a way as to form a portion 46 with which the cassette contacts when the cassette is inserted which causes the slider 40 to slide. The other end of the slider 40 forms an engaging portion 48 which extends to a position to contact the block 28 as the cassette is inserted. In addition, the other end of the slider 40 is also pulled by means of a spring 50 in the direction which is opposite to the insertion direction of the cassette.

Furthermore, a lever 52 is rotatably supported by means of a pin 54 and spring-biased clockwise by means of a further spring (not shown). A pin 56 extending from one end of the lever 52 is selectively engageable with one end of the lever 20 in the vicinity of the pin 24 projecting therefrom.

In accordance with the cassette type apparatus described above, prior to the insertion of a cassette, the pin 24 of the lever 20 engages the notch 26 of the block 28 and is retained therein as shown in FIG. 2. In addition, the pressing member 16 is in the retracted lowered position, and the pin 32 is engaged with the slot 30 of the block 28 at the lowest portion of the slot 30. Also, the slider 40 is pulled to the left in FIGS. 2 and 3 by means of the spring 50, and accordingly, the slot 42 of the slider 40 is engaged with the pin 44 at the left most end of the slot 42. The engaging portion 48 of the slider 40 is positioned to the right of the block 28 in FIGS. 2 and 3, that is, at the side closest to the opening P for the insertion of the cassette for feeding papers.

Figure 5:
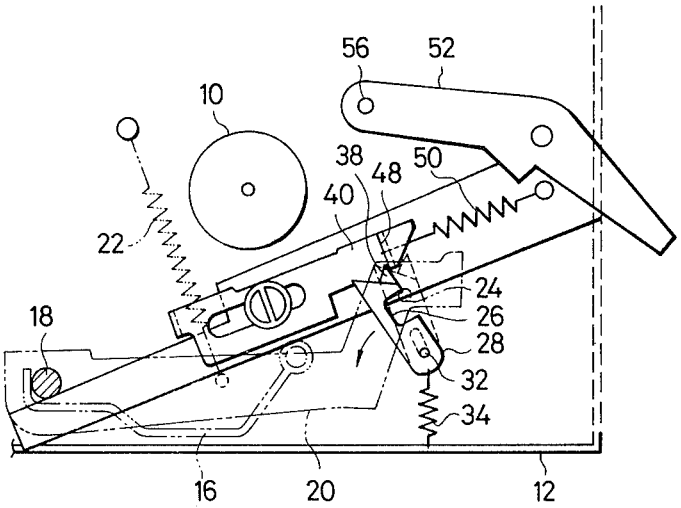
FIG. 5 is a view similar to FIG. 2 showing the state where the cassette is being inserted.
Figure 6:
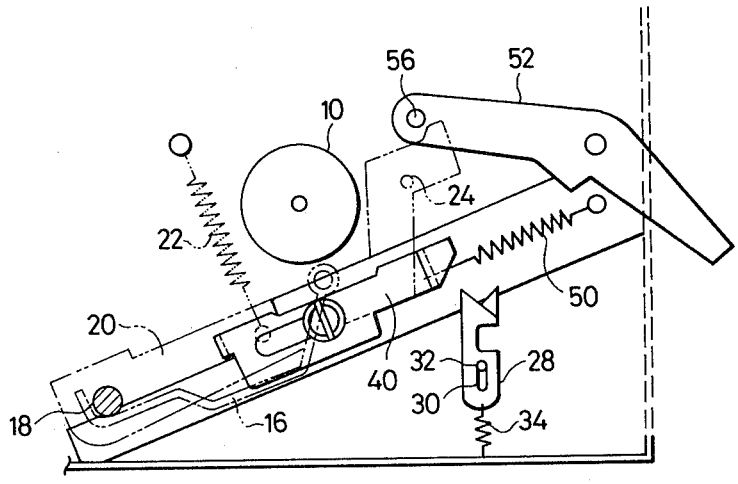
FIG. 6 is a view similar to FIG. 2 showing the state in which the cassette is completely inserted.

If the cassette for feeding papers is inserted into the opening P from the right in FIG. 3 when the cassette type apparatus is in the state described above, the front surface of the cassette for feeding papers comes in contact with the portion 46 of the slider 40 so that the slider is moved to the left in FIGS. 2 and 3. The movement of the slider 40 causes the engaging portion 48 of the slider 40 to collide with the top portion of the inclined surface 38 of the block 28, so that the block 28 for determining position swings counterclockwise about the pin 32 as shown in FIG. 5. As a result, the pin 24 of the lever 20 is released from the notch 26 of the block 28. Accordingly, as shown in FIG. 6, the lever 20 and the pressing member 16 swing counterclockwise about the rotary shaft 18 due to the biasing force of the spring 22, so that the pressing member 16 pushes up the bottom plate in the cassette. The other end of the lever 20 is positioned in the vicinity of the pin 56 of the lever 52. After the pin 24 is released from the notch 26, the block 28 is pulled downward by the spring 34, so that the upper portion of the slot 30 which is formed in the block 28 engages the pin 32 as shown in FIG. 6. In addition, the block 28 is linearly aligned with the pulling direction of the spring 34, so that the slot 30 is substantially vertically oriented.

Figure 7:
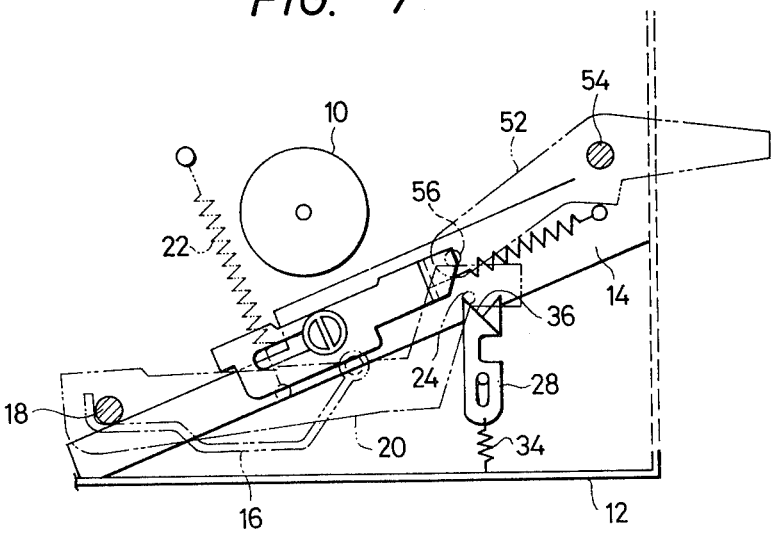
FIG. 7 is a view similar to FIG. 2 showing the operative state of a lever 52 when the cassette is inserted.

When the cassette for feeding papers is to be drawn out, the operator rotates the lever 52 counterclockwise about the pin 54, so that the pin 56 engages the lever 20 causing the lever 20 to rotate clockwise. When the lever 20 rotates clockwise, the pin 24 of the lever 20 comes in contact with the inclined surface 36 of the block 28, as shown in FIG. 7, and moves downwards along the inclined surface 36 until the pin 24 enters the notch 26. Accordingly, lever 20 is kept in the retracted position by the block 28. When the lever 52 is returned to its original position by rotating clockwise about the pin 54, the block 28 is pulled upwards by the lever 20, and the slot 30 thus returns to the state in which the lower portion thereof engages the pin 32 as shown in FIG. 8.

Figure 8:
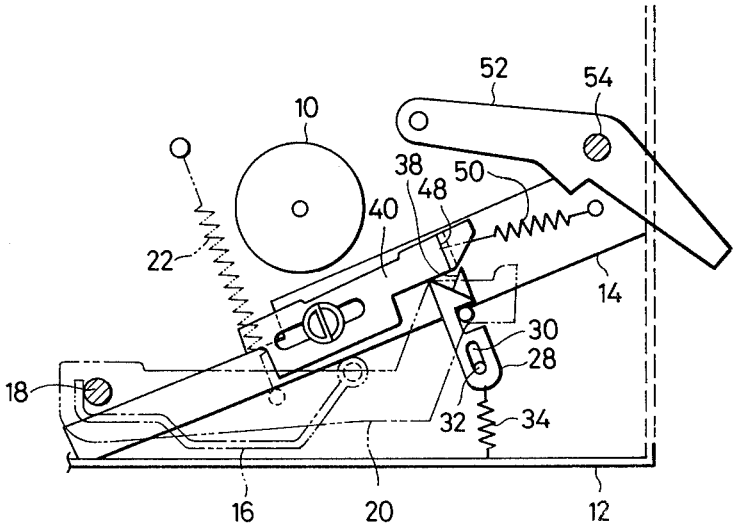
FIG. 8 is a view similar to FIG. 2 showing the state when the cassette is being drawn out of the apparatus.

If the lever 20 is kept in the retracted position as shown in FIGS. 2 and 8, the pressing member 16 is also kept in the retracted position, so that the cassette can be drawn out. Finally, the slider 40 is caused to slide to the right in FIG. 8 by the force of the spring 50 simultaneously with this operation to draw out the cassette. At this time, the engaging portion 48 of the slider 40 comes in contact with the inclined surface 38 of the block 28 as shown in FIG. 8, goes up on the inclined surface, moves to the right, gets over the block 28 and returns to the state as shown in FIG. 2.

As mentioned above, it is possible to set the pressing member 16 in the pressing state merely by inserting the cassette in accordance with the present invention. Accordingly, a separation is not required to set the pressing member when the cassette has been inserted in the copier or like machine. In addition, since the lever 20 is separate from the lever 52, the lever 20 does not come in contact with the lever 52 when the pressing member 16 is in the pressing state. Thus, the pressing member 16 pushes only the papers which are stored in the cassette against the feed roller, and the lever 52 does not impose a load on the spring 22. Therefore, it becomes possible to correctly set the pushing force of the papers by means of the spring 22.

What is claimed is:

1. A cassette type apparatus for feeding papers from a cassette insertable into a machine having a feed roller, comprising:

a first lever commonly rotatable
with a pressing member;

first means for biasing said first lever and said pressing member towards said feed roller;

a block for selectively engaging said first lever, said first lever being in a retracted state when engaged with said block;

means for rotatably mounting said block;

a slider engageable with said cassette and said block and slidable with said cassette as said cassette is inserted into said machine, for rotating said block, rotation of said block disengaging said first lever allowing said pressing member to urge said inserted cassette towards said feed roller; and reset lever means for reengaging said first lever and said block.

2. The apparatus as claimed in claim 1 further comprising an auxiliary frame having guide means for guiding said cassette into and out of said machine.

3. The apparatus as claimed in claim 2 wherein said slider is mounted in said auxiliary frame and adapted to slide along said auxiliary frame, said slider having a longitudinal slot for accommodating a pin projecting from said auxiliary frame for limiting sliding movement of said slider.

4. The apparatus as claimed in claim 3 wherein said slider has one end portion which extends into a passage of said apparatus for engaging said cassette as said cassette is inserted into said machine.

5. The apparatus as claimed in claim 1 further comprising an apparatus frame having a first pin projecting therefrom, said block having a notch for receiving therein a second pin which projects from a side surface of said first lever, said block also having an elongated slot therein engageable with said first pin projecting from said apparatus frame.

6. The apparatus as claimed in claim 5 further comprising a spring connected to a lower end of said block for urging said block downward, said block further having an upper portion which faces said first lever, said upper portion having first and second surfaces inclined in opposite directions, said first inclined surface being formed to guide said second pin projecting from said side surface of said first lever into said notch of said block.

7. The apparatus as claimed in claim 1 further comprising means for rotatably supporting said reset lever, a first end of said reset lever being selectively engageable with said first lever.

* * * * *